US009694610B2

(12) United States Patent
Izawa et al.

(10) Patent No.: US 9,694,610 B2
(45) Date of Patent: Jul. 4, 2017

(54) INKJET PRINTER, PRINTING METHOD USING THE SAME, AND AUTOMATIC WEB THREADING METHOD

(71) Applicant: MIYAKOSHI PRINTING MACHINERY CO., LTD., Narashino-shi, Chiba (JP)

(72) Inventors: Hideo Izawa, Narashino (JP); Kouichi Ooyama, Yokote (JP); Takehiro Fujiwara, Yokote (JP); Seiji Komatsuda, Yokote (JP); Kazushige Sato, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 15/058,868

(22) Filed: Mar. 2, 2016

(65) Prior Publication Data

US 2017/0021650 A1 Jan. 26, 2017

(30) Foreign Application Priority Data

Jul. 21, 2015 (JP) ..... 2015-144444

(51) Int. Cl.

| | |
|---|---|
| ***B41J 15/16*** | (2006.01) |
| ***B41J 11/30*** | (2006.01) |
| *B41J 2/01* | (2006.01) |
| *B41J 11/32* | (2006.01) |

(52) U.S. Cl.

CPC ..... *B41J 15/165* (2013.01); *B41J 11/30* (2013.01); *B41J 15/16* (2013.01); *B41J 2/01* (2013.01); *B41J 11/32* (2013.01)

(58) Field of Classification Search

CPC ..... B41J 15/165; B41J 2/01

See application file for complete search history.

(56) References Cited

U.S. PATENT DOCUMENTS

| | | | | |
|---|---|---|---|---|
| 5,358,345 | A * | 10/1994 | Damitio | B41J 11/58 400/613.2 |
| 2011/0200378 | A1* | 8/2011 | Moriyama | B41J 11/30 400/583 |
| 2012/0062675 | A1* | 3/2012 | Kawakami | B41J 11/42 347/104 |

(Continued)

FOREIGN PATENT DOCUMENTS

| | | | |
|---|---|---|---|
| JP | 08-216467 | A | 8/1996 |
| JP | 2014-034140 | A | 2/2014 |

*Primary Examiner* — Alessandro Amari
*Assistant Examiner* — Roger W Pisha, II
(74) *Attorney, Agent, or Firm* — Flynn, Thiel, Boutell & Tanis, P.C.

(57) ABSTRACT

An inkjet printer 100 that carries out printing with respect to long continuous paper X provided with a perforation M at every page break and provided with marginal punch holes P in both sides, the inkjet printer having: a paper feeding unit 1 that disposes the Z-folded continuous paper X; a first pull roller 2*a* and a second pull roller 2*b* for conveying the continuous paper X; a pin tractor 3 for positioning the continuous paper X; a speed-variable motor 4 for applying tension to the continuous paper X; a printing unit 5 that carries out printing on the continuous paper X by a print head; and a discharging unit 6 that Z-folds and discharges the continuous paper X by a folding machine 61.

16 Claims, 8 Drawing Sheets

(56) References Cited

U.S. PATENT DOCUMENTS

| | | | | |
|---|---|---|---|---|
| 2013/0050379 | A1* | 2/2013 | Ebina | B65H 20/20<br>347/104 |
| 2013/0083147 | A1* | 4/2013 | Maeda | B41J 11/30<br>347/104 |
| 2014/0116275 | A1* | 5/2014 | Walker | B41J 15/04<br>101/424.1 |

* cited by examiner

INKJET PRINTER, PRINTING METHOD USING THE SAME, AND AUTOMATIC WEB THREADING METHOD

TECHNICAL FIELD

The present invention relates to an inkjet printer, a printing method using the same, and an automatic web threading method and more particularly relates to an inkjet printer that carries out printing by an inkjet method with respect to long continuous paper, which is provided with perforations at every page break and is provided with marginal punch holes in both sides, to a printing method using the inkjet printer, and an automatic web threading method of the inkjet printer.

BACKGROUND ART

An inkjet printer which carries out printing at a high speed by an inkjet method with respect to long continuous paper provided with marginal punches in both sides is known.

In the inkjet printer, pins of pin tractors are inserted in marginal punch holes of the continuous paper, and conveyance of the continuous paper is carried out by driving the pin tractors.

As a specific example, for example, a top/back printing apparatus 1 which is configured to carry out printing on both sides of the top side and the back side of rotary paper by a printing unit using an inkjet printer is known (see Patent Literature 1). In the top/back printing apparatus, if the rotary paper 6 has feed pin holes (marginal punch holes), pin tractors 21 provided in the printing unit 4 are configured to convey the rotary paper 6 with timing.

Also, a printer 1 that carries out printing on continuous paper 2 provided with sprocket holes 2*a* (marginal punch holes) in paper-width-direction both-end parts is known (see Patent Literature 2). In the printer, the continuous paper 2 is configured to be fed into a printer main body 3 from the rear side of the apparatus by a tractor 4, is subjected to printing, and is then discharged to the front side of the apparatus from the printer main body 3.

Note that, in the printer 1, the continuous paper 2 is conveyed by the tractor 4 and is passed to a paper feeding roller 8, conveyance of the continuous paper 2 is started by the conveyance force of the paper feeding roller 8, the continuous paper 2 is positioned at a print position A, and printing corresponding to the amount of one page is carried out.

Moreover, control of the printing is carried out based on signals from a roller encoder 14 mounted on a rotary shaft of the paper feeding roller 8, and a so-called cueing is carried out based on the signals from a tractor encoder 20, which detects the feed amount of the tractor.

CITATION LIST

Patent Literature

PTL 1: Japanese Patent Application Laid-Open No. H08-216467

PTL 2: Japanese Patent Application Laid-Open No. 2014-34140

SUMMARY OF INVENTION

Technical Problem

Meanwhile, continuous paper in which a plurality of ledger sheets, etc. are continued and connected is provided with perforations at every page break and is provided with marginal punch holes in both sides.

The continuous paper is alternately folded at every perforation and handled in a so-called Z-folded state.

When the continuous paper like this is sequentially conveyed from a front end by using the top/back printing apparatus described in the above described Patent Literature 1 or the printer described in the above described Patent Literature 2, there is a problem that upward or downward ridges caused by creases are generated at the positions of the perforations of the continuous paper.

If printing is carried out on the continuous paper while carrying out the conveyance in a state in which the upward or downward ridges are generated, there are the disadvantages that a misalignment of printing is caused and the printing quality is deteriorated, the continuous paper contacts a print head, which intrinsically does not contact the continuous paper, a defective discharge of the print head is caused, and a print head surface may be damaged.

Meanwhile, in the top/back printing apparatus described in the above-described Patent Literature 1, there is no description about an automatic web threading method. In the printer described in the above-described Patent Literature 2, automatic web threading can be carried out; however, upward or downward ridges as described above may be generated, particularly ahead of the paper feeding roller 8.

The present invention has been accomplished in view of the above-described circumstances, and it is an object to provide an inkjet printer that can reduce the generation of upward or downward ridges with respect to Z-folded continuous paper as much as possible, to provide a printing method using the same, and to provide an automatic web threading method that enables automatic web threading without causing jamming during processing and enables web threading in a state in which the generation of upward or downward ridges is reduced as much as possible.

Solution to Problems

The present inventors have carried out extensive studies in order to solve the above-described problems, found out a fact that the above-described problems can be solved by applying a tension to the conveyed continuous paper, and accomplished the present invention.

Note that, in the conveyance and printing with respect to the continuous paper provided with marginal punch holes and provided with perforations at every page break, if the tension is excessively applied, the vicinities of the marginal punch holes of the continuous paper may rupture, and the rupture may occur at the perforations. Therefore, conventionally, conveyance and printing is carried out with no tension.

The present invention resides in (1) An inkjet printer that carries out printing by an inkjet method with respect to a long continuous paper provided with a perforation at every page break and marginal punch holes in both sides, the inkjet printer having: a paper feeding unit that disposes the Z-folded continuous paper; a first pull roller and a second pull roller for conveying the continuous paper; a pin tractor for positioning the continuous paper; a speed-variable motor for applying a tension to the continuous paper; a printing unit that carries out printing on the continuous paper by a print head; and a discharging unit that Z-folds and discharges the continuous paper by a folding machine; wherein the pin tractor has pins and can carry out positioning of the continuous paper by inserting the pins in the marginal punch holes; a holding skid for sandwiching the continuous paper abuts the first pull roller, and a driving motor is attached to the first pull roller; a gripper roller for sandwiching the continuous paper abuts the second pull roller, and the speed-variable motor is attached to the second pull roller; and the speed-variable motor applies the tension to the continuous paper by changing a rotating speed of the second pull roller.

The present invention resides in (2) the inkjet printer according to the above-described (1), wherein, in a conveyance path of the continuous paper, the pin tractor, the first pull roller, the printing unit, and the second pull roller are disposed in this order from an upstream side.

The present invention resides in (3) the inkjet printer according to the above-described (1) or (2), further having back-tension rollers consisting of a plurality of rollers for guiding the continuous paper and, at the same time, applying the tension; wherein, in the conveyance path of the continuous paper, the back-tension rollers are provided between the paper feeding unit and the pin tractor; the BT speed-variable motor is attached to at least one roller of the back-tension rollers; and the BT speed-variable motor applies the tension to the continuous paper by changing a rotating speed of the roller.

The present invention resides in (4) the inkjet printer according to any one of above-described (1) to (3), further having a drying unit for drying the printed continuous paper; wherein, in the conveyance path of the continuous paper, the drying unit is provided between the printing unit and the second pull roller.

The present invention resides in (5) the inkjet printer according to any one of above-described (1) to (4), wherein the print head is a line head.

The present invention resides in (6) the inkjet printer according to any one of above-described (1) to (5), wherein a pin-tractor encoder is attached to the pin tractor; and a reference detecting sensor for detecting a front end of the continuous paper is attached to a side opposed to the pin tractor via the continuous paper.

The present invention resides in (7) a printing method using the inkjet printer according to above-described (6), the printing method of: generating print-starting timing by a transmitter based on a reference value using a particular position of the continuous paper detected by the reference detecting sensor as a reference, a detection value obtained by counting a pulse of the pin-tractor encoder output in proportion to a movement distance of the pin tractor, and a print-length information of one page set in the transmitter; transmitting a print command; and carrying out printing on the continuous paper by the print head that received the print command.

The present invention resides in (8) the printing method according to above-described (7), wherein a distance from the perforation to a position of the continuous paper at which printing is actually desired to be started is set in advance; and the time required to convey the continuous paper by the distance is added to the print-starting timing to delay transmission of the print command.

The present invention resides in (9) the printing method using the inkjet printer according to above-described (6), wherein, if an unprinted page of the continuous paper passes the printing unit, the continuous paper is conveyed in a reverse direction of a conveyance direction by rotating the first pull roller and the second pull roller in the reverse direction based on a detection value of the pin-tractor encoder so that printing can be started from the unprinted first page, the continuous paper is then conveyed in a forward direction again, and printing is carried out.

The present invention resides in (10) the printing method using the inkjet printer according to any one of above-described (1) to (6), wherein, if a conveyance speed of the continuous paper is decelerated, recording is carried out by a resolution of a point immediately before the deceleration and, if the conveyance speed of the continuous paper is accelerated, recording is carried out by a resolution of a point immediately after the acceleration.

The present invention resides in (11) an automatic web threading method of an inkjet printer that carries out printing by an inkjet method with respect to long continuous paper provided with a perforation at every page break and marginal punch holes in both sides, the inkjet printer having: a paper feeding unit that disposes the Z-folded continuous paper; a first pull roller, an intermediate pull roller, and a second pull roller for conveying the continuous paper; a first pin tractor and a second pin tractor for carrying out positioning of the continuous paper; a printing unit that carries out printing on the continuous paper by a print head; and a discharging unit that Z-folds and discharges the continuous paper by a folding machine; wherein, each of the first pin tractor and the second pin tractor has pins and carries out positioning of the continuous paper by inserting the pins in the marginal punch holes; a driving motor is attached to the first pin tractor via a clutch; the driving motor is directly attached to the second pin tractor; the second pin tractor is movable so as to go to a state in which the pins are removed from the marginal punch holes from a state in which the pins are inserted in the marginal punch holes; a paper-detecting sensor for detecting a front end of the continuous paper is attached to a side opposed to the second pin tractor via the continuous paper; the first pull roller, the intermediate pull roller, and the second pull roller respectively abut detachable gripper rollers for sandwiching the continuous paper and are attached to driving motors and, in a conveyance path of the continuous paper, the first pin tractor, the first pull roller, the printing unit, the intermediate pull roller, the second pin tractor, and the second pull roller are disposed in this order from an upstream side, the automatic web threading method having: a first step of inserting the pins of the first pin tractor in the marginal punch holes of the continuous paper; a second step of connecting the clutch, driving the first pin tractor by the driving motor, conveying the continuous paper until the front end of the continuous paper is detected by the paper-detecting sensor, and then stopping driving of the first pin tractor by the driving motor; a third step of causing the detached gripper roller to abut the intermediate pull roller, sandwiching the continuous paper between the intermediate pull roller and the gripper roller, conveying the continuous paper to the downstream side at an extremely low speed by the intermediate pull roller, and applying tension to the continuous paper that is between the intermediate pull roller and the first pin tractor; a fourth step of inserting the pins of the second pin tractors in the marginal punch holes of the continuous paper; a fifth step of disconnecting the clutch so that the first pin tractor follows the conveyance of the continuous paper, driving the second pin tractor by the driving motor, and conveying the continuous paper to the discharging unit; a sixth step of moving the second pin tractor in order to remove the pins from the marginal punch holes; and a seventh step of sandwiching the continuous paper between the first pull roller and the gripper roller abutting the first pull roller and between the second pull roller and the gripper roller abutting the second pull roller and conveying the continuous paper.

Advantageous Effects of Invention

In the inkjet printer of the present invention, the speed-variable motor is attached to the second pull roller among the first pull roller and the second pull roller. Therefore, when the speed-variable motor changes the rotating speed of the second pull roller, a tension can be applied to the continuous paper.

Specifically, the tension can be applied to the continuous paper by increasing the rotating speed of the second pull roller by a predetermined rate higher than the rotating speed of the first pull roller from a state in which the rotating speed of the first pull roller and the rotating speed of the second pull roller are synchronized.

Note that the continuous paper provided with the perforations at every page break may be ruptured at the perforations if the tension is excessively applied. Therefore, the rate of increasing the rotating speed of the second pull roller to the rotating speed of the first pull roller is preferred to be maximally an increase of about 0.05%, in other words, plus about 0.05% in a decimation rate.

By virtue of this, even when the continuous paper Z-folded and disposed in the paper feeding unit is conveyed, a constant tension is applied to the continuous paper. Therefore, upward or downward ridges caused by creases at the positions of the perforations can be prevented from being generated.

Moreover, upon printing, a misalignment of printing and deterioration in printing quality can be prevented, and the print head can be also prevented from contacting the continuous paper.

In the inkjet printer of the present invention, in the conveyance path of the continuous paper, if the pin tractors, the first pull roller, the printing unit, and the second pull roller are disposed in this order from the upstream side, an appropriate tension can be applied across the entire conveyance path of the continuous paper.

In the inkjet printer of the present invention, in the conveyance path of the continuous paper, the back-tension rollers provided between the paper feeding unit and the pin tractors is further provided, and the back-tension-roller speed-variable motor (hereinafter, referred to as "BT speed-variable motor") is attached to at least one roller of the back-tension rollers. If the BT speed-variable motor is one that applies a tension to the continuous paper by changing the rotating speed of the roller, the tension is applied also to the continuous paper which is between the paper feeding unit and the pin tractors. Therefore, the pins of the pin tractors can be precisely inserted in the marginal punch holes of the continuous paper.

By virtue of this, the defective following of the pin tractors with respect to the continuous paper can be prevented.

In the inkjet printer of the present invention, if the drying unit for drying the printed continuous paper is further provided, the printed continuous paper can be dried before discharging. Therefore, the printed matters can be prevented from being transferred to other continuous paper after discharge.

Moreover, if the drying unit is provided between the printing unit and the second pull roller in the conveyance path of the continuous paper, since a tension is applied to the continuous paper, the continuous paper can be uniformly dried.

In the inkjet printer of the present invention, if the print head is a line head, printing can be carried out at a high speed.

In the inkjet printer of the present invention, if the pin-tractor encoder is attached to the pin tractor and the reference detecting sensor for detecting the front end of the continuous paper is attached to the side opposed to the pin tractor via the continuous paper, the positional information of the conveyed continuous paper can be recognized by detecting the continuous paper by the reference detecting sensor and measuring the movement distance of the pin tractor, which follows the continuous paper, by the pin-tractor encoder.

By virtue of this, printing can be started when an appropriate part reaches the printing unit.

In the printing method of the present invention, the transmitter generates the print-starting timing based on the reference value using a particular position of the continuous paper detected by the reference detecting sensor as a reference, the detection value obtained by counting the pulses of the pin-tractor encoder output in proportion to the movement distance of the pin tractor, and the print-length information of one page set in the transmitter and transmits the print command, and the print head which has received the print command carries out printing on the continuous paper. Therefore, printing can be carried out by a simple process flow.

As a result, even when the continuous paper is conveyed at a high speed, printing can be carried out to follow that.

In the printing method of the present invention, the distance from the perforations to the position of the continuous paper at which printing is actually desired to be started is set in advance, the time required to convey the continuous paper by the distance is added to the print-starting timing to delay transmission of the print command. Therefore, correction can be appropriately carried out so that the print-starting position becomes appropriate.

In the printing method of the present invention, if an unprinted page of the continuous paper passes the printing unit, the blank paper part (unprinted page) which has passed the printing unit can be prevented from being wasted by conveying the continuous paper in the reverse direction of the conveyance direction by rotating at least the first pull roller and the second pull roller in the reverse direction based on the detection value of the pin-tractor encoder so that printing can be started from the unprinted first page, then conveying the continuous paper again in the forward direction, and carrying out printing.

In the printing method of the present invention, if the conveyance speed of the continuous paper is decelerated, recording is carried out by the resolution of a point immediately before the deceleration; and, if the conveyance speed of the continuous paper is accelerated, recording is carried out by the resolution of a point immediately after the acceleration. As a result, even in a case of acceleration/deceleration of the continuous paper, printing can be continuously carried out, and blurring and lack of sharpness of printing can be suppressed.

In the automatic web threading method of the present invention, by carrying out the first step, the second step, the third step, the fourth step, the fifth step, the sixth step, and the seventh step, automatic web threading can be smoothly carried out without causing jamming during the process.

Moreover, since a tension is applied to the Z-folded continuous paper, web threading can be carried out in a state in which the generation of upward or downward ridges is suppressed, particularly at the printing unit.

DESCRIPTION OF EMBODIMENTS

Figure 1:
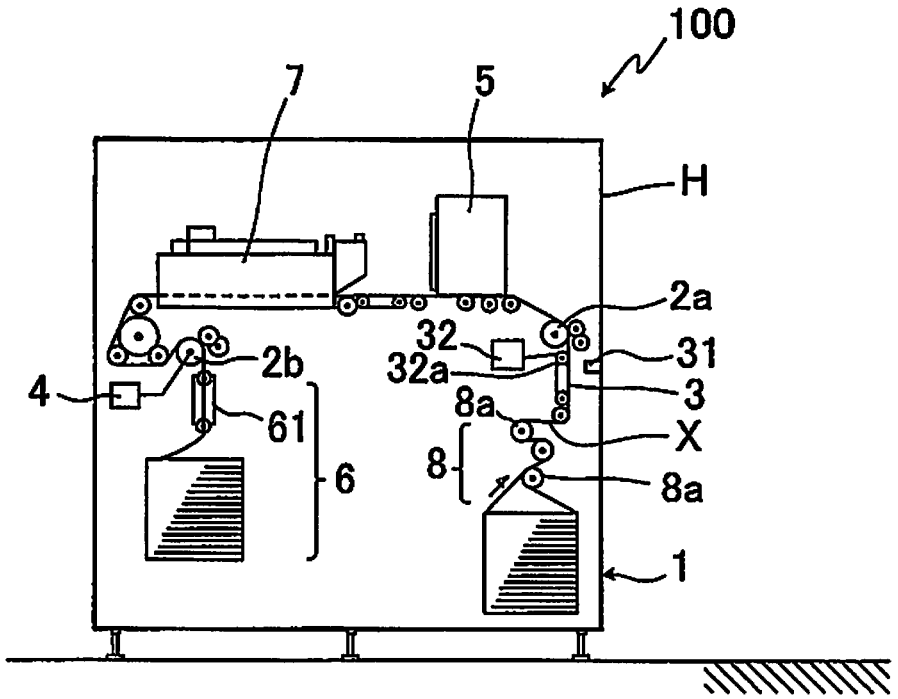
FIG. 1 is a front view showing an overview of an inkjet printer according to a present embodiment.

Hereinafter, with reference to the drawings in accordance with needs, a preferred embodiment of the present invention will be explained in detail. Note that, in the drawings, the same elements are denoted by the same reference signs, and redundant explanations will be omitted. Meanwhile, positional relations such as upper, lower, left, right, etc. are based on the positional relations shown in the drawings unless otherwise stated. Furthermore, the dimensional proportions of the drawings are not limited to the proportions shown in the drawings.

Figure 8:
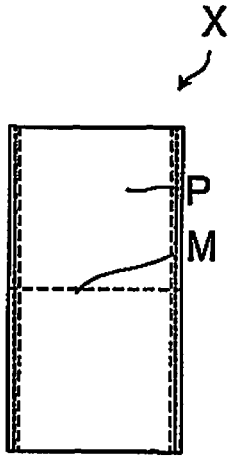
FIG. 8 is a front view showing part of the continuous paper used in the inkjet printer according to the present invention.

An inkjet printer according to the present invention is an apparatus for carrying out printing by an inkjet method with respect to a long continuous paper X (see FIG. 8), which is provided with perforations M at every page break and is provided with marginal punch holes P in both sides.

First, an embodiment of the inkjet printer according to the present invention will be explained.

FIG. 1 is a front view showing an overview of an inkjet printer according to the present embodiment.

As shown in FIG. 1, the inkjet printer 100 according to the present embodiment is provided with: a paper feeding unit 1, in which a Z-folded continuous paper X is disposed; back-tension rollers 8 for applying a tension at the same time as when the continuous paper X is guided; a first pull roller 2*a* and a second pull roller 2*b* for conveying the continuous paper X; pin tractors 3 for positioning the continuous paper X; a speed-variable motor 4 for applying a tension to the continuous paper X; a printing unit 5, which carries out printing on the continuous paper X by a print head (not shown); a drying unit 7 for drying the printed continuous paper X; a discharging unit 6, which Z-folds and discharges the continuous paper X by a folding machine 61; and a housing H for incorporating and protecting them.

Hereinafter, each component will be explained in further detail.

The paper feeding unit 1 is a part in which the Z-folded continuous paper X is disposed.

Note that the paper feeding unit 1 is provided in the housing H, but is not limited thereto, and may be provided outside the housing H.

The back-tension rollers 8 consist of a plurality of rollers 8*a* and are disposed between the paper feeding unit 1 and the pin tractors 3.

A BT speed-variable motor (not shown) is attached to at least one roller 8*a* of the back-tension rollers 8.

Note that, examples of the BT speed-variable motor include a servomotor which can control the speed, etc. in a servomechanism, a differential transmission mounted on an electric motor other than that, etc.

The back-tension rollers 8 can apply a tension when the continuous paper X is guided. More specifically, when the BT speed variable motor changes the rotating speed of the roller 8*a* with respect to the rotating speed of the first pull roller 2*a* or the second pull roller 2*b* described later, a tension can be applied to the continuous paper X, and adjustment of the tension is enabled. Therefore, since a tension is applied to the continuous paper X between the paper feeding unit 1 and the pin tractors 3, pins of the pin tractors 3 can be precisely and reliably inserted in the marginal punch holes P of the continuous paper X during conveyance of the continuous paper.

As a result, defective following of the pin tractors 3 with respect to the continuous paper can be prevented.

The pin tractors 3 are provided in a pair so as to correspond to the marginal punch holes P provided in both sides of the continuous paper X. Note that the pair of the pin tractors 3 are configured to be moved in synchronization with each other.

The pin tractors 3 have the same structure as publicly known ones and have the pins, which are to be engaged with the marginal punch holes P, and driving sprockets 32*a*, which drive a pin-attached pin belt in a conveyance direction.

Therefore, the pin tractors 3 can carry out the positioning of the continuous paper X by inserting the pins of the pin tractors 3 into the marginal punch holes P, which are provided in both sides of the continuous paper X.

Herein, in the side opposed via the continuous paper X of the pin tractors 3, a reference detecting sensor 31 is attached.

The reference detecting sensor 31 can set a reference, for example, by detecting a front end of the continuous paper X.

If the front end of the continuous paper X has already passed the reference detecting sensor 31 when the continuous paper X is positioned and attached to the pin tractors 3, the reference detecting sensor 31 cannot detect the front end of the continuous paper X, therefore, after back feeding the continuous paper X, the continuous paper X can be moved forward, and the front end of the continuous paper X can be detected by the reference detecting sensor 31. Note that the reference is not limited to the front end of the continuous paper X, but may be an arbitrary position.

Moreover, a pin-tractor encoder 32 is attached to at least one of the driving sprockets 32*a* of the pin tractors 3 to which the reference detecting sensor 31 is attached.

The pin-tractor encoder 32 is configured to measure the movement distance of the pin tractor 3.

By virtue of this, a particular position detected by the reference detecting sensor 31 is used as a reference, and the pin-tractor encoder 32 measures the movement distance of the pin tractor 3 and, as a result, the positional information of the conveyed continuous paper X can be recognized.

Therefore, based on the above described positional information, printing can be started when an appropriate position reaches the printing unit 5. Note that details of a printing method thereof will be described later.

In the inkjet printer 100, gripper rollers for sandwiching the continuous paper X are respectively abutting the first pull roller 2*a* and the second pull roller 2*b*.

Moreover, a driving motor (not shown) is attached to the first pull roller 2*a*, and the speed-variable motor 4 is attached to the second pull roller 2*b*.

Therefore, the continuous paper X can be conveyed by sandwiching the continuous paper X between the first pull roller 2*a* and the corresponding gripper roller, driving the first pull roller 2*a* by the driving motor, sandwiching the continuous paper X between the second pull roller 2*b* and the corresponding gripper roller, and driving the second pull roller 2*b* by the speed-variable motor 4.

Note that, examples of the speed-variable motor 4 include a servo motor which can control the speed, etc. in a servomechanism, a differential transmission mounted on an electric motor other than that, etc.

At the second pull roller 2*b*, when the speed-variable motor 4 changes the rotating speed of the second pull roller 2*b* with respect to the rotating speed of the first pull roller 2*a*, a tension can be applied to the continuous paper X and adjustment of the tension is enabled. Therefore, since a tension is applied also to the continuous paper X that is between the first pull roller 2*a* and the second pull roller 2*b*, particularly at the printing unit 5, upward or downward ridges caused by creases can be prevented from being generated at the positions of the perforations of the continuous paper X.

Moreover, upon printing, misalignment of printing and deterioration in printing quality can be prevented, and the print head can be also prevented from contacting the continuous paper X.

Note that, if the tension is excessively applied to the paper, which is provided with the perforations at every page break, the paper may be ruptured by the perforations, therefore, it is preferred that the rate of increasing the rotating speed of the second pull roller than the rotating speed of the first pull roller be maximally an increase of about 0.05%, in other words, be up to plus about 0.05% in a decimation rate.

The printing unit 5 incorporates the print head (not shown), and printing is carried out on the continuous paper X by the print head.

As the print head, a serial head, a line head, or the like can be employed; however, from a viewpoint of high-speed printing, it is preferred to employ a line head.

The drying unit 7 is a part for drying the printed continuous paper X.

Since the drying unit 7 can dry the printed continuous paper X before discharge, the matters printed on predetermined pages can be prevented from being transferred to other pages after discharge.

Moreover, since the drying unit 7 is provided between the printing unit 5 and the second pull roller 2*b* in a conveyance path of the continuous paper, there is a state in which a tension is applied to the continuous paper X.

Therefore, the continuous paper X can be uniformly dried.

The paper discharging unit 6 is a part which Z-folds the printed continuous paper X by the folding machine 61 and discharges the paper.

Note that the paper discharging unit 6 is provided in the housing H, but is not limited thereto, and may be provided outside the housing H.

In the inkjet printer 100 according to the present embodiment, the paper feeding unit 1, the back-tension rollers 8, the pin tractors 3, the first pull roller 2*a*, the printing unit 5, the drying unit 7, the second pull roller 2*b*, and the paper discharging unit 6 are disposed in this order from the upstream side of the conveyance path of the continuous paper X, therefore, an appropriate tension can be applied across the entire conveyance path of the continuous paper X. Particularly, at the printing unit, a sufficient tension can be applied.

Specifically, an appropriate tension can be applied by changing the rate of increasing the rotating speed of the second pull roller to the rotating speed of the first pull roller depending on the thickness and/or material of the continuous paper X. Generally, the rate is higher for thick paper than for thin paper.

Next, a printing method using the inkjet printer 100 according to the present embodiment will be explained.

Figure 2:
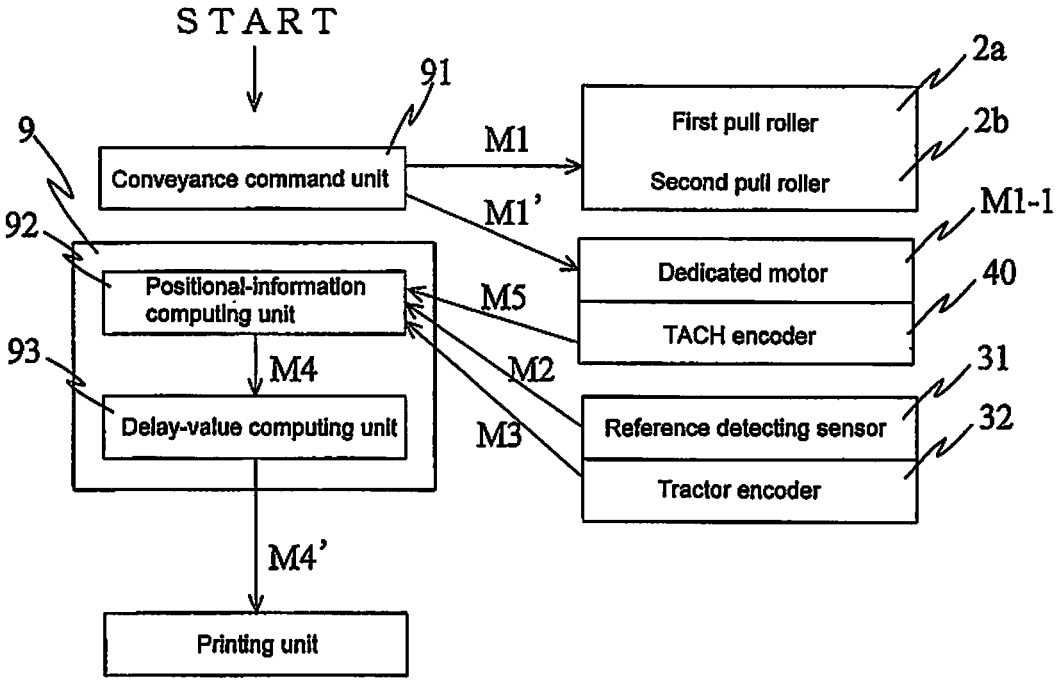
FIG. 2 is a flow chart showing a printing method using the inkjet printer according to the present embodiment.

FIG. 2 is a flow chart showing the printing method using the inkjet printer according to the present embodiment.

As shown in FIG. 2, in the printing method using the inkjet printer, first, before the front end of the continuous paper X is detected by the reference detecting sensor 31, in other words, before web threading, the print length of one page is set in a transmitter 9.

Then, when a start button to start printing is pressed, a conveyance command unit 91 (for example, motion control) transmits a conveyance command M1 to the first pull roller 2*a* and the second pull roller 2*b*. As a result, conveyance of the continuous paper X is started.

Moreover, a conveyance command M1' is transmitted also to a dedicated motor M1-1 from the conveyance command unit 91, and the dedicated motor M1-1 rotates a TACH encoder 40. Note that the TACH encoder 40 is synchronized with the first pull roller 2*a* or the second pull roller 2*b*.

Then, the TACH encoder 40 transmits a TACH pulse M5, which is oscillated from the TACH encoder, to a positional-information computing unit 92.

Then, a particular position of the paper detected by the reference detecting sensor 31 is set as a reference, and a reference value M2 thereof is transmitted to the transmitter 9.

Moreover, since the pin tractor 3 is driven when the continuous paper X is conveyed, a pulse M3 of the pin-tractor encoder 32, which is output in proportion to the movement distance of the pin tractor 3, is transmitted to the transmitter 9.

Then, the positional-information computing unit 92 of the transmitter 9 generates print-starting timing by calculating positional information based on the TACH pulse M5, the reference value M2, a detection value obtained by counting the pulse(s) M3, and the print-length information of one page set in the transmitter 9 in advance and transmits a print command M4 to the printing unit 5.

Then, a delay-value computing unit 93 of the transmitter 9 calculates the time (delay value) required to convey the continuous paper X by a distance from the perforations M of the continuous paper X set in advance to the position at which printing is actually desired to be started.

Then, a print command M4', which is a transmission-delayed print command by adding the delay value to the print-starting timing, is transmitted.

Figure 3:
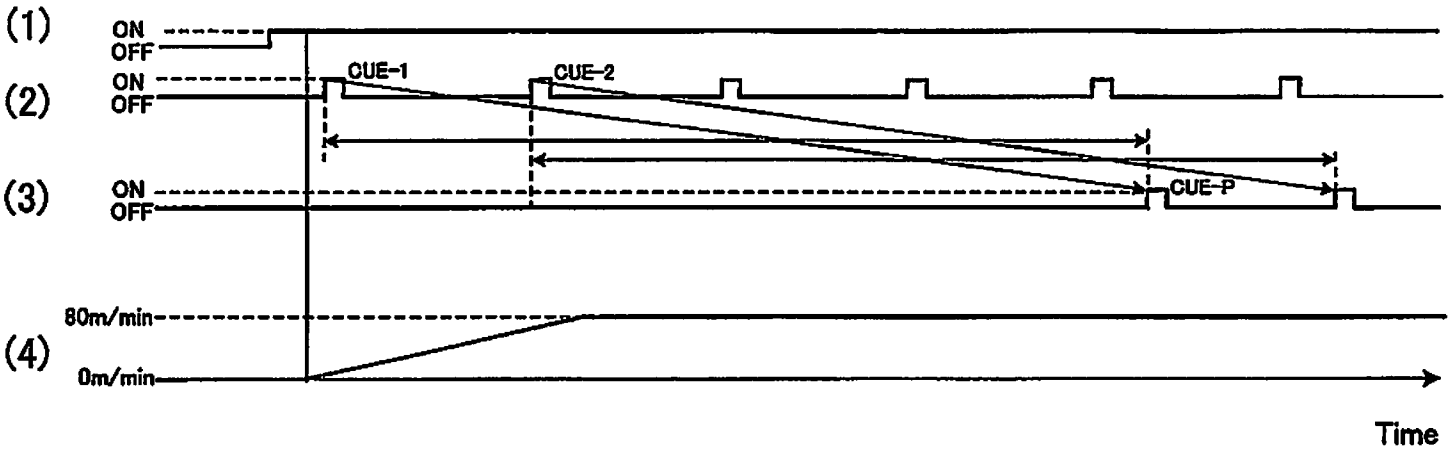
FIG. 3 shows a graph for explaining a delay value in the printing method using the inkjet printer according to the present embodiment.

FIG. 3 shows a graph for explaining the delay value in the printing method using the inkjet printer according to the present embodiment. In FIG. 3, the graph (1) shows ON/OFF of the start button to start printing, the graph (2) shows ON/OFF of the print command M4 transmitted by the transmitter 9, the graph (3) shows ON/OFF of an actual print-starting position, and the graph (4) shows the conveyance speed of the continuous paper X.

As shown in FIG. 3, the (ON) timing of the print command M4 transmitted by the transmitter 9 and the (ON) timing of the actual print-starting position do not match, and a time lag is generated therebetween.

Specifically, for example, there is a difference between the timing of a first print command CUE-1 transmitted by the transmitter 9 and a first print-starting position CUE-P.

The difference in the timing is the delay value.

The delay-value computing unit 93 delays the print command by the amount of the delay value set in advance.

Note that the delay value is changed depending on the distance from the perforations set in advance to the position of actual printing.

Also, if the speed is constant, the delay value is not changed and, if the speed is changed, the delay value is changed depending on that. Also, a specific value of the delay value is set based on empirical rules.

By virtue of this, printing can be carried out from the actual printing position instead of the perforations.

Even if there is a lag based on the conveyance speed of the continuous paper X between the print command M4 transmitted by the transmitter 9 and the actual print-starting position, or if there is a difference in the landing time depending on the distances from nozzle heads to the opposed continuous paper X, an appropriate modification can be carried out so as to obtain an appropriate print-starting position by adjusting the above-described delay value in consideration of them.

Then, the print head which has received the print command M4' at the modified timing carries out printing on the continuous paper X.

In this manner, in the printing method using the inkjet printer, printing can be carried out by a simple process flow. Therefore, even if the continuous paper X is conveyed at a high speed, printing can be carried out to follow that.

In the printing method using the inkjet printer, even in a state in which the conveyance speed of the continuous paper X is accelerated or decelerated, printing can be carried out.

Figure 4:
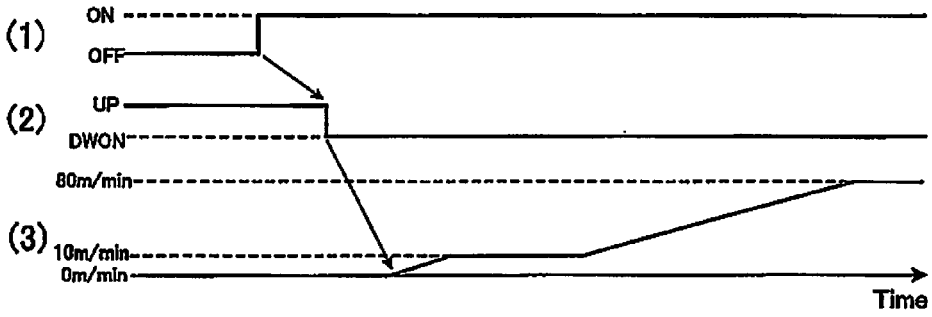
FIG. 4 shows a graph showing an example in which the continuous paper is accelerated in the printing method using the inkjet printer according to the present embodiment.

FIG. 4 shows a graph showing an example in which the continuous paper is accelerated in the printing method using the inkjet printer according to the present embodiment. In FIG. 4, the graph of (1) shows ON/OFF of the print command, the graph of (2) shows UP/DOWN of the print head, and the graph of (3) shows the conveyance speed of the continuous paper X.

As shown in FIG. 4, when the print command becomes ON, the print head becomes DOWN, and a standby state of printing is obtained.

Then, at the same time as the start of printing, the conveyance speed of the continuous paper X is accelerated from 0 m/min to 10 m/min, becomes a constant speed of 10 m/min until the temperature of a drying machine becomes constant, and is then accelerated from 10 m/min to 80 m/min.

In other words, not only in the case in which the conveyance speed of the continuous paper X is a constant speed, but also in the case in which it is accelerated, printing can be continuously carried out.

Note that, although it is not shown in the drawing, even in the case in which the continuous paper X is decelerated, printing can be continuously carried out.

Herein, in the above-described printing method, if the conveyance speed of the continuous paper is decelerated, recording is carried out by the resolution of a point immediately before the deceleration and, if the conveyance speed of the paper is accelerated, recording is carried out by the resolution of a point immediately after the acceleration.

For example, in a case of deceleration, if the conveyance speed of the continuous paper X is simply decelerated, the resolution is gradually increased, therefore, a low resolution is maintained by decelerating the conveyance speed of the continuous paper X and delaying the timing of discharging the ink by the print head.

In a case of acceleration, if the conveyance speed of the continuous paper X is simply accelerated, the resolution is gradually reduced, therefore, a low resolution is maintained by accelerating the conveyance speed of the continuous paper X and advancing the timing of discharging the ink by the print head.

By virtue of this, even in a case of acceleration or deceleration of the continuous paper X, continuous printing is enabled, and blurring and lack of sharpness of printing can be reduced.

Next, a printing method using a back-feed function will be explained.

The inkjet printer 100 according to the present embodiment has a so-called back-feed function of conveying the continuous paper X in a reverse direction.

Figure 5:
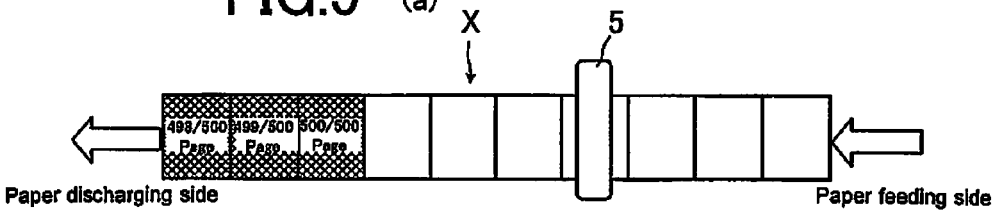
FIG. 5(*a*) to (*c*) are explanatory drawings for explaining a printing method utilizing a back-feed function of an inkjet printer according to the present embodiment.
Figure 5:
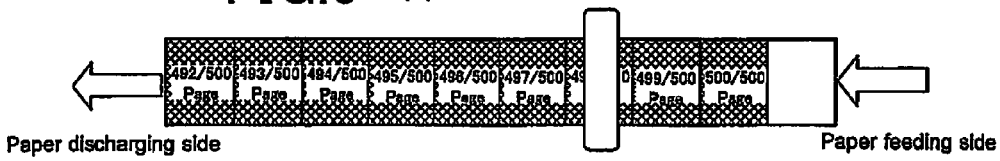
Figure 5:
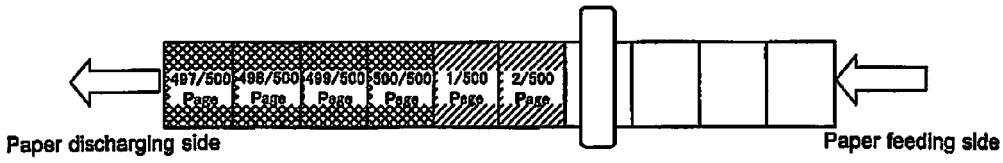

FIG. 5(*a*) to (*c*) are explanatory drawings for explaining the printing method utilizing the back-feed function of the inkjet printer according to the present embodiment.

For example, if printing is stopped during the processing thereof and the conveyance of the paper is then stopped, since the paper is conveyed at a high speed, as shown in FIG. 5(*a*), unprinted pages of the continuous paper X pass the printing unit 5, and an extremely large blank paper part is generated.

In this case, at least the first pull roller 2*a* and the second pull roller 2*b* are rotated in the reverse direction based on the detection value of the above-described pin-tractor encoder 32 so that printing can be started from the first unprinted page. As a result, as shown in FIG. 5(*b*), the continuous paper X is conveyed in the reverse direction of the conveyance direction and is stopped when at least the downstream side of the first page of the blank paper part reaches the upstream side of the printing unit 5.

Then, as well as the above-described printing method, the transmitter 9 transmits the conveyance command M1, the continuous paper X is conveyed in the forward direction again, the print command M4 is transmitted based on the reference value M2 and the detection value, and printing is started with a delay by the amount corresponding to the delay value.

In this process, as shown in FIG. 5(*c*), paper waste can be eliminated by starting the printing from the blank paper part (unprinted page) at which the print starting position has passed the printing unit 5.

Next, an automatic web threading method according to the present invention will be explained.

Figure 6:
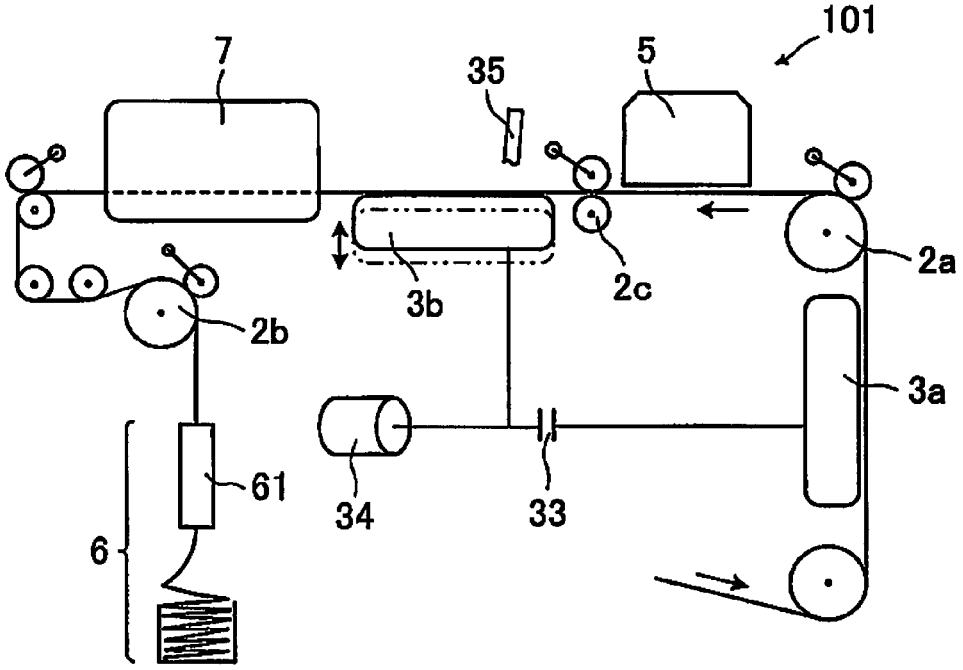
FIG. 6 is a schematic drawing showing an overview of an inkjet printer used in an automatic web threading method according to the present embodiment.

FIG. 6 is a schematic drawing showing an overview of an inkjet printer used in an automatic web threading method according to the present embodiment.

As shown in FIG. 6, an inkjet printer 101 used in the automatic web threading method according to the present embodiment is provided with: a paper feeding unit (not shown), in which a Z-folded continuous paper X is disposed; a first pull roller 2*a*, an intermediate pull roller 2*c*, and a second pull roller 2*b* for carrying the continuous paper X; first pin tractors 3*a* and second pin tractors 3*b* for positioning the continuous paper X; a printing unit 5, which carries out printing on the continuous paper X by a print head (not shown); a drying unit 7 for drying the printed continuous paper X; a discharging unit 6, which Z-folds and discharges the continuous paper X by a folding machine 61; and a housing (not shown) for incorporating and protecting them.

Hereinafter, each component will be explained in further detail.

The paper feeding unit 1 is a part in which the Z-folded continuous paper X is disposed.

Note that the paper feeding unit 1 may be provided in the housing or may be provided outside the housing.

The first pin tractors 3*a* are provided in a pair so as to correspond to the marginal punch holes P provided in both sides of the continuous paper X. Note that the pair of the first pin tractors 3*a* are configured to be moved in synchronization with each other.

Also, the second pin tractors 3*b* have similar structures.

Each of the first pin tractors 3*a* and the second pin tractors 3*b* have the same structure as publicly known ones and have the pins, which are to be engaged with the marginal punch holes P, and a driving sprocket 32*a*, which drives a pin-attached pin belt in a conveyance direction.

Therefore, the first pin tractors 3*a* and the second pin tractors 3*b* can carry out positioning of the continuous paper X by inserting the pins of the first pin tractors 3*a* and the second pin tractors 3*b* into the marginal punch holes P, which are provided in both sides of the continuous paper X.

Moreover, a driving motor 34 is attached to the first pin tractors 3*a* via a clutch 33, and the driving motor 34 is directly attached to the second pin tractors. Thus, the first pin tractors 3*a* and the second pin tractors 3*b* are configured to be driven by the driving motor 34.

Furthermore, the second pin tractors 3*b* can be moved in a top-bottom direction by an unshown up/down driving apparatus so as to obtain a state in which the pins are removed from the marginal punch holes from a state in which the pins are inserted in the marginal punch holes.

Herein, a paper detecting sensor 35 is attached to the side opposed to the second pin tractors 3*b* via the continuous paper X.

The paper detecting sensor 35 can judge the presence/absence of the continuous paper X, for example, by detecting the front end of the continuous paper X.

In the inkjet printer 101, gripper rollers for sandwiching the continuous paper X are respectively abutting the first pull roller 2*a*, the intermediate pull roller 2*c*, and the second pull roller 2*b*.

Herein, a driving apparatus such as an air cylinder is attached to each of the gripper rollers, and the driving apparatus causes the gripper roller to be detachable/attachable with respect to the corresponding pull roller.

Moreover, driving motors (not shown) are attached respectively to the first pull roller 2*a*, the intermediate pull roller 2*c*, and the second pull roller 2*b*.

Therefore, the continuous paper X can be conveyed by sandwiching the continuous paper X between the first pull roller 2*a* and the corresponding gripper roller, driving the first pull roller 2*a* by the driving motor, sandwiching the continuous paper X between the second pull roller 2*b* and the corresponding gripper roller, and driving the second pull roller 2*b* by the driving motor.

The printing unit 5 incorporates the print head (not shown), and printing is carried out on the continuous paper X by the print head.

As the print head, a serial head, a line head, or the like can be employed; however, from a viewpoint of high-speed printing, it is preferred to employ a line head.

The drying unit 7 is a part for drying the printed continuous paper X.

Since the drying unit 7 can dry the printed continuous paper X before discharge, the matters printed on predetermined pages can be prevented from being transferred to other pages after discharge.

Moreover, since the drying unit 7 is provided between the printing unit 5 and the second pull roller 2*b* in a conveyance path of the continuous paper, by obtaining a state in which a tension is applied to the continuous paper X, the continuous paper X can be uniformly dried.

The paper discharging unit 6 is a part which Z-folds the printed continuous paper X by the folding machine 61 and discharges the paper.

Note that the paper discharging unit 6 is provided in the housing, but may be provided outside the housing.

In the inkjet printer 101, the paper feeding unit 1, the first pin tractors 3*a*, the first pull roller 2*a*, the printing unit 5, the intermediate pull roller 2*c*, the second pin tractors 3*b*, the drying unit 7, the second pull roller 2*b*, and the paper discharging unit 6 are disposed in this order from the upstream side of the conveyance path of the continuous paper X. Therefore, later-described automatic web threading can be efficiently carried out.

Next, the automatic web threading method according to the present embodiment will be explained.

Figure 7:
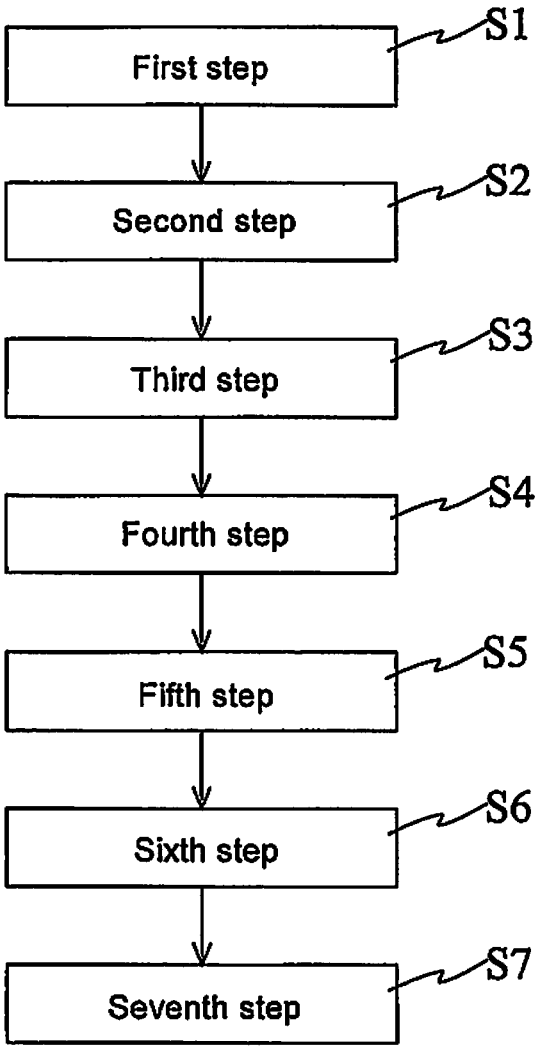
FIG. 7 is a flow chart showing the automatic web threading method according to the present embodiment.

FIG. 7 is a flow chart showing the automatic web threading method according to the present embodiment.

As shown in FIG. 7, the automatic web threading method according to the present embodiment consists of a first step S1, a second step S2, a third step S3, a fourth step S4, a fifth stem S5, a sixth step S6, and a seventh step S7 explained below.

In the first step S1, the pins of the first pin tractors 3*a* are inserted in the marginal punch holes P at the front end of the continuous paper X.

Note that the first step S1 is carried out by a worker.

As a result, positioning of the continuous paper X is carried out.

In the second step S2, the clutch 33 is connected, and the first pin tractors 3*a* are driven by the driving motor 34 to convey the continuous paper X.

In this process, the front end of the continuous paper X passes the first pull roller 2*a*, which is not abutting the gripper roller, the printing unit 5, and the intermediate pull roller 2*c*, which is not abutting the gripper roller.

Then, after the continuous paper X is conveyed until the front end of the continuous paper X is detected by the paper detecting sensor 35, driving of the first pin tractors 3*a* by the driving motor 34 is stopped.

In the third step S3, the gripper roller, which has been detached, is caused to abut the intermediate pull roller 2*c*, and the continuous paper X is sandwiched between the intermediate pull roller 2*c* and the gripper roller.

Then, the intermediate pull roller 2*c* conveys the continuous paper X to the downstream side at an extremely low speed. In this process, although driving of the first pin tractors 3*a* is stopped, the clutch 33 is connected, therefore, when the intermediate pull roller 2*c* conveys the continuous paper X to the upstream side at the extremely low speed, a tension is applied to the continuous paper X. As a result, between the intermediate pull roller 2*c* and the first pin tractors 3*a*, for example, the continuous paper X of the printing unit 5 is in a tension-applied state. In this process, the abutting pressure of the gripper roller abutting the intermediate pull roller 2*c* is adjusted to cause slipping so that the intermediate pull roller 2*c* does not excessively pull the continuous paper X.

In the fourth step S4, the pins of the second pin tractors 3*b* are inserted in the marginal punch holes P of the continuous paper X.

More specifically, in the above described third step S3, the intermediate pull roller 2*c* conveys the continuous paper X to the upstream side at an extremely low speed so that the positions of the pins of the second pin tractors 3*b* and the marginal punch holes P of the continuous paper X match.

Then, when the positions of the pins of the second pin tractors 3*b* and the marginal punch holes P of the continuous paper X match, the second pin tractors 3*b* are moved up by the up/down driving apparatus, and the pins of the second pin tractors 3*b* are inserted in the marginal punch holes P of the continuous paper X.

In the fifth step S5, by disconnecting the clutch 33, the first pin tractors 3*a* are caused to be in a freely rotatable state and follow conveyance of the continuous paper X.

Then, at least the second pin tractors 3*b* are driven by the driving motor 34, and the continuous paper X is conveyed to the drying unit 7 and the discharging unit 6.

In this process, the front end of the continuous paper X passes the drying unit 7 and the second pull roller 2*b*, which is not abutting the gripper roller.

Then, after the continuous paper X is conveyed to the discharging unit 6, driving of the second pin tractors 3*b* by the driving motor 34 is stopped.

In the sixth step S6, in order to remove the pins from the marginal punch holes P, the second pin tractors 3*b* are moved down by the up/down driving apparatus. Note that the first pin tractors 3*a*, which are freely rotatable, are maintained in the state in which the pins are inserted in the marginal punch holes P.

In the seventh step S7, the holding skid corresponding to the first pull roller 2*a* is caused to abut the first pull roller 2*a* by using the driving apparatus, and the gripper roller corresponding to the second pull roller 2*b* is caused to abut the second pull roller 2*b* by using the driving apparatus.

As a result, the continuous paper X is sandwiched between the first pull roller 2*a* and the gripper roller abutting the first pull roller 2*a* and between the second pull roller 2*b* and the gripper roller abutting the second pull roller 2*b*.

Then, by driving the first pull roller 2*a* and the second pull roller 2*b* by the driving motor, the continuous paper X, which has undergone automatic web threading, can be conveyed.

In the automatic web threading method according to the present embodiment, by carrying out the first step S1, the second step S2, the third step S3, the fourth step S4, the fifth step S5, the sixth step S6, and the seventh step S7, automatic web threading can be smoothly carried out without causing jamming during the process.

Also, even with the Z-folded continuous paper X, since a tension is applied, particularly at the printing unit 5, web threading can be carried out in a state in which the generation of upward and downward ridges is suppressed.

Hereinabove, the suitable embodiment of the present embodiment has been explained, but the present invention is not limited to the above described embodiment.

For example, the inkjet printer 100 according to the present embodiment is provided with the paper feeding unit 1, the back-tension rollers 8, the first pull roller 2*a*, the second pull roller 2*b*, the pin tractors 3, the speed-variable motor 4, the printing unit 5, the drying unit 7, the discharging unit 6, and the housing H. However, the back-tension rollers 8 and the drying unit 7 are not necessarily essential components.

Also, the inkjet printer may be further provided with the intermediate pull roller 2*c*, the second pin tractor 3*b*, the paper detecting sensor 35, etc. and used in the above described automatic web threading method.

The inkjet printer 101 used in the automatic web threading method according to the present embodiment is provided with the paper feeding unit, the first pull roller 2*a*, the intermediate pull roller 2*c*, the second pull roller 2*b*, the first pin tractors 3*a*, the second pin tractors 3*b*, the printing unit 5, the drying unit 7, the discharging unit 6, and the housing. However, the drying unit 7 is not necessarily an essential component.

Also, the inkjet printer may be further provided with the speed-variable motor 4 and/or the back-tension rollers 8.

Furthermore, the inkjet printer may be further provided with the reference detecting sensor 31, the pin-tractor encoder 32, etc. and used in the above-described printing method.

The above-described inkjet printers 100, 101 may further have different pull rollers or may have rollers for simply guiding the continuous paper X other than the first pull roller 2*a*, the second pull roller 2*b*, etc. for conveying the continuous paper X.

Also, a paper guide for preventing the continuous paper X from falling may be provided so as to be along the conveyance path.

In the inkjet printer 100 according to the present embodiment, the paper feeding unit 1, the back-tension rollers 8, the pin tractors 3, the first pull roller 2*a*, the printing unit 5, the drying unit 7, the second pull roller 2*b*, and the paper discharging unit 6 are disposed in this order from the upstream side of the conveyance path of the continuous paper X. However, the disposed positions of the pin tractors 3 are not particularly limited.

In the inkjet printer 100 according to the present embodiment, the pin tractors 3 are provided in a pair so as to correspond to the marginal punch holes P provided in both sides of the continuous paper X; wherein, the pair of pin tractors 3 may be coupled to each other.

In the printing method of the inkjet printer 100 according to the present embodiment, the transmitter 9 is employed. However, instead of the transmitter 9, a general computer provided with a central processing device (CPU), an arithmetic processing unit, a storage unit, an image processing unit, an input/output device (keyboard, display), etc. may be used.

In the inkjet printer 101 used in the automatic web threading method according to the present embodiment, the first pin tractor 3*a* and the second pin tractor 3*b* are attached to the same driving motor 34, but may be respectively attached to different driving motors.

INDUSTRIAL APPLICABILITY

The inkjet printers according to the present invention and the printing methods using the same are used in uses to carry out printing by an inkjet method with respect to long continuous paper, which is provided with perforations at every page break and is provided with marginal punch holes in both sides.

Also, the automatic web threading method according to the present invention is used as a method to automatically carry out web threading with respect to an inkjet printer by using long continuous paper, which is provided with perforations at every page break and is provided with marginal punch holes in both sides.

REFERENCE SIGNS LIST

1 . . . paper feeding unit,
2*a* . . . first pull roller,
2*b* . . . second pull roller,
2*c* . . . intermediate pull roller,
3 . . . pin tractor
3*a* . . . first pin tractor,
3*b* . . . second pin tractor,

31 . . . reference detecting sensor,
32 . . . pin-tractor encoder,
33 . . . clutch,
34 . . . driving motor,
35 . . . paper detecting sensor,
4 . . . speed-variable motor,
40 . . . TACH encoder,
5 . . . printing unit,
6 . . . discharging unit,
61 . . . folding machine,
7 . . . drying unit,
8 . . . back-tension rollers,
8*a* . . . roller,
9 . . . transmitter,
91 . . . conveyance command unit,
92 . . . positional-information computing unit,
93 . . . delay-value computing unit,
100, 101 . . . inkjet printer,
H . . . housing,
M . . . perforations,
M1, M1' . . . conveyance command,
M2 . . . reference value,
M3 . . . pulse,
M4, M4' . . . print command,
M5 . . . TACH pulse,
P . . . marginal punch holes,
S1 . . . first step,
S2 . . . second step,
S3 . . . third step,
S4 . . . fourth step,
S5 . . . fifth step,
S6 . . . sixth step,
S7 . . . seventh step, and
X . . . continuous paper.

The invention claimed is:

1. An automatic web threading method of an inkjet printer that carries out printing by an inkjet method with respect to a long Z-folded continuous paper provided with a perforation at every page break and provided with marginal punch holes in both sides, the inkjet printer comprising:

a paper feeding unit that disposes the Z-folded continuous paper; a first pull roller, an intermediate pull roller, and a second pull roller for conveying the continuous paper; a first pin tractor and a second pin tractor for carrying out positioning of the continuous paper; a printing unit that carries out printing on the continuous paper by a print head; and a discharging unit that Z-folds and discharges the continuous paper by a folding machine; wherein, each of the first pin tractor and the second pin tractor has pins and carries out positioning of the continuous paper by inserting the pins in the marginal punch holes;

a driving motor is attached to the first pin tractor via a clutch;

the driving motor is directly attached to the second pin tractor;

the second pin tractor is movable so as to become a state in which the pins are removed from the marginal punch holes from a state in which the pins are inserted in the marginal punch holes;

a paper detecting sensor for detecting a front end of the continuous paper is attached to a side opposed to the second pin tractor via the continuous paper;

a first detachable gripper roller for sandwiching the continuous paper abuts the first pull roller, a third detachable gripper roller for sandwiching the continuous paper abuts the intermediate pull roller, a second detachable gripper roller for sandwiching the continuous paper abuts the second pull roller, and driving motors are respectively attached to the first pull roller, the intermediate pull roller and the second pull roller; and, in a conveyance path of the continuous paper, the first pin tractor, the first pull roller, the printing unit, the intermediate pull roller, the second pin tractor, and the second pull roller are disposed in this order from an upstream side;

the automatic web threading method comprising the steps of:

a first step of inserting the pins of the first pin tractor in the marginal punch holes of the continuous paper;

a second step of connecting the clutch, driving the first pin tractor by the driving motor, conveying the continuous paper until the front end of the continuous paper is detected by the paper detecting sensor, and then stopping driving of the first pin tractor by the driving motor;

a third step of causing the detached third gripper roller to abut the intermediate pull roller, sandwiching the continuous paper between the intermediate pull roller and the third gripper roller, conveying the continuous paper to the upstream side at an extremely low speed by the intermediate pull roller, and applying tension to the continuous paper that is between the intermediate pull roller and the first pin tractor;

a fourth step of inserting the pins of the second pin tractors in the marginal punch holes of the continuous paper;

a fifth step of disconnecting the clutch so that the first pin tractor follows conveyance of the continuous paper, driving the second pin tractor by the driving motor, and conveying the continuous paper to the discharging unit;

a sixth step of moving the second pin tractor in order to remove the pins from the marginal punch holes; and a seventh step of sandwiching the continuous paper between the first pull roller and the first gripper roller abutting the first pull roller and between the second pull roller and the second gripper roller abutting the second pull roller and conveying the continuous paper.

2. An inkjet printer that carries out printing by an inkjet method with respect to a long Z-folded continuous paper provided with a perforation at every page break and provided with marginal punch holes in both sides, the inkjet printer comprising:

a paper feeding unit that disposes the Z-folded continuous paper;

a first pull roller and a second pull roller for conveying the continuous paper;

a pin tractor for positioning the continuous paper;

a speed-variable motor for applying a tension to the continuous paper;

a printing unit that carries out printing on the continuous paper by a print head;

back-tension rollers consisting of a plurality of rollers for guiding the continuous paper and, at the same time, applying the tension and a discharging unit that Z-folds and discharges the continuous paper by a folding machine; wherein the pin tractor has pins and can carry out positioning of the continuous paper by inserting the pins in the marginal punch holes;

a first gripper roller for sandwiching the continuous paper abuts the first pull roller, and a driving motor is attached to the first pull roller;

a second gripper roller for sandwiching the continuous paper abuts the second pull roller, and the speed-variable motor is attached to the second pull roller;

the speed-variable motor applies the tension to the continuous paper by changing a rotating speed of the second pull roller;

in the conveyance path of the continuous paper, the back-tension rollers are provided between the paper feeding unit and the pin tractor;

the speed-variable motor is attached to at least one roller of the back-tension rollers; and the speed-variable motor applies the tension to the continuous paper by changing a rotating speed of the roller.

3. The inkjet printer according to claim 2, wherein, in a conveyance path of the continuous paper, the pin tractor, the first pull roller, the printing unit, and the second pull roller are disposed in this order from an upstream side.

4. The inkjet printer according to claim 2, further comprising a drying unit for drying the printed continuous paper; wherein, in the conveyance path of the continuous paper, the drying unit is provided between the printing unit and the second pull roller.

5. The inkjet printer according to claim 2, wherein the print head is a line head.

6. An inkjet printer that carries out printing by an inkjet method with respect to a long Z-folded continuous paper provided with a perforation at every page break and provided with marginal punch holes in both sides, the inkjet printer comprising:

a paper feeding unit that disposes the Z-folded continuous paper;

a first pull roller and a second pull roller for conveying the continuous paper;

a pin tractor for positioning the continuous paper;

a speed-variable motor for applying a tension to the continuous paper;

a printing unit that carries out printing on the continuous paper by a print head; and a discharging unit that Z-folds and discharges the continuous paper by a folding machine; wherein the pin tractor has pins and can carry out positioning of the continuous paper by inserting the pins in the marginal punch holes;

a first gripper roller for sandwiching the continuous paper abuts the first pull roller, and a driving motor is attached to the first pull roller;

a second gripper roller for sandwiching the continuous paper abuts the second pull roller, and the speed-variable motor is attached to the second pull roller;

the speed-variable motor applies the tension to the continuous paper by changing a rotating speed of the second pull roller;

a pin-tractor encoder is attached to the pin tractor; and a reference detecting sensor for detecting a front end of the continuous paper is attached to a side opposed to the pin tractor via the continuous paper.

7. A printing method using the inkjet printer according to claim 6, the printing method comprising the steps of:

generating print-starting timing by a transmitter based on a reference value using a particular position of the continuous paper detected by the reference detecting sensor as a reference, a detection value obtained by counting a pulse of the pin-tractor encoder output in proportion to a movement distance of the pin tractor, and a print-length information of one page set in the transmitter;

transmitting a print command; and carrying out printing on the continuous paper by the print head that received the print command.

8. The printing method according to claim 7, wherein a distance from the perforation to a position of the continuous paper at which printing is actually desired to be started is set in advance; and the time required to convey the continuous paper by the distance is added to the print-starting timing to delay transmission of the print command.

9. The printing method using the inkjet printer according to claim 6, wherein, if an unprinted page of the continuous paper passes the printing unit, the continuous paper is conveyed in a reverse direction of a conveyance direction by rotating the first pull roller and the second pull roller in the reverse direction based on a detection value of the pin-tractor encoder so that printing can be started from the unprinted first page, the continuous paper is then conveyed in a forward direction again, and printing is carried out.

10. The inkjet printer according to claim 6, further comprising a drying unit for drying the printed continuous paper; wherein, in the conveyance path of the continuous paper, the drying unit is provided between the printing unit and the second pull roller.

11. The inkjet printer according to claim 6, wherein the print head is a line head.

12. The inkjet printer according to claim 6, wherein, in a conveyance path of the continuous paper, the pin tractor, the first pull roller, the printing unit, and the second pull roller are disposed in this order from an upstream side.

13. An inkjet printer that carries out printing by an inkjet method with respect to a long Z-folded continuous paper provided with a perforation at every page break and provided with marginal punch holes in both sides, the inkjet printer comprising:

a paper feeding unit that disposes the Z-folded continuous paper;

a first pull roller and a second pull roller for conveying the continuous paper;

a pin tractor for positioning the continuous paper;

a speed-variable motor for applying a tension to the continuous paper;

a printing unit that carries out printing on the continuous paper by a print head; and a discharging unit that Z-folds and discharges the continuous paper by a folding machine; wherein the pin tractor has pins and can carry out positioning of the continuous paper by inserting the pins in the marginal punch holes;

a first gripper roller for sandwiching the continuous paper abuts the first pull roller, and a driving motor is attached to the first pull roller;

a second gripper roller for sandwiching the continuous paper abuts the second pull roller, and the speed-variable motor is attached to the second pull roller;

the speed-variable motor applies the tension to the continuous paper by changing a rotating speed of the second pull roller;

if a conveyance speed of the continuous paper is decelerated, recording is carried out by a resolution of a point immediately before the deceleration; and, if the conveyance speed of the continuous paper is accelerated, recording is carried out by a resolution of a point immediately after the acceleration.

14. The inkjet printer according to claim 13, further comprising a drying unit for drying the printed continuous paper; wherein, in the conveyance path of the continuous paper, the drying unit is provided between the printing unit and the second pull roller.

15. The inkjet printer according to claim 13, wherein the print head is a line head.

16. The inkjet printer according to claim 13, wherein, in a conveyance path of the continuous paper, the pin tractor, the first pull roller, the printing unit, and the second pull roller are disposed in this order form an upstream side.

* * * * *